United States Patent [19]

Soileau et al.

[11] Patent Number: 4,601,765

[45] Date of Patent: Jul. 22, 1986

[54] POWDERED IRON CORE MAGNETIC DEVICES

[75] Inventors: Trasimond A. Soileau, Flat Rock; Lawrence W. Speaker, Hendersonville, both of N.C.

[73] Assignee: General Electric Company, Hendersonville, N.C.

[21] Appl. No.: 491,830

[22] Filed: May 5, 1983

[51] Int. Cl.[4] ..... H01F 1/02

[52] U.S. Cl. ..... 148/104; 148/31.55; 75/234; 75/246

[58] Field of Search ..... 148/31.55, 104, 105, 148/31.5; 427/127, 216; 75/234, 246, 251; 428/403, 570

[56] References Cited

U.S. PATENT DOCUMENTS

| | | | |
|---|---|---|---|
| 3,245,841 | 4/1966 | Clarke et al. | 148/31.5 |
| 3,725,521 | 4/1973 | Ebling | 264/104 |
| 3,917,976 | 11/1975 | Nuckolls | 315/258 |
| 4,177,089 | 12/1979 | Bankson | 148/31.55 |
| 4,227,166 | 10/1980 | Tsuji et al. | 148/104 |

FOREIGN PATENT DOCUMENTS

| | | | |
|---|---|---|---|
| 55-130103 | 10/1980 | Japan | 148/104 |
| 765891 | 9/1980 | U.S.S.R. | 148/104 |

*Primary Examiner*—John P. Sheehan

*Attorney, Agent, or Firm*—Henry J. Policinski

[57] ABSTRACT

A compacted powdered iron core utilizes iron powder in the 0.002 to 0.006 mean particle size range which is first coated with an alkali metal silicate and then overcoated with a silicone resin polymer. The treated powder is compressed to approximately 94% of theoretical density and then annealed at approximately 600° C. This results in a core component characterized by overall core losses as low as in conventional laminated cores in A.C. operation.

20 Claims, 1 Drawing Figure

POWDERED IRON CORE MAGNETIC DEVICES

The invention relates to compacted powdered iron core magnetic devices and to materials and methods for making high permeability low loss magnetic circuit components suitable for use in electromagnetic devices, particularly in transformers and inductors intended for discharge lamp ballast circuits operating at commercial power line frequencies.

BACKGROUND OF THE INVENTION

Magnetic materials fall generally into two classes, magnetically hard substances which may be permanently magnetized, and magnetically soft substances of high permeability. It is with the latter that the present invention is concerned. Permeability is a measure of the ease with which a magnetic substance can be magnetized and it is given by the ratio B/H, H representing the magnetic force necessary to produce the magnetic induction B. In most power applications, such as transformers or inductors, motors, generators and relays, iron is used as the magnetic material and high permeability together with low losses are highly desirable.

When magnetic material is exposed to a rapidly varying field, it is subject to hysteresis losses and eddy current losses. The hysteresis loss results from the expenditure of energy to overcome the magnetic retentive forces within the iron. The eddy current loss results from the flow of electric currents within the iron induced by the changing flux. Hysteresis and eddy current losses together make up the core or iron losses in a transformer or electromagnetic device. The conventional practice in making magnetic cores for use in transformers has been to form a laminated structure by stacking thin ferrous sheets. The sheets are oriented parallel to the magnetic field to assure low reluctance. They may be varnished or otherwise coated to provide insulation between sheets which prevents current from circulating between sheets and this keeps eddy current losses low. Conventional laminated transformers and inductors require many different operations in their manufacture.

The use of sintered powder metal avoids the manufacturing burden inherent in laminated structures but, due to the high core losses, has generally been restricted to applications involving direct current operation such as relays. Alternating current applications require that the iron particles be insulated from one another in order to reduce eddy current losses. Powder cores made of magnetic iron oxide and other metal oxides combined to form a ceramic (ferrite), or of iron powder dispersed in plastic material, are used in high frequency and signal level circuits. To our knowledge metal powder cores have not heretofore been used for power transformers or motors due to their low flux carrying capability.

In a typical reactor ballast for a high intensity discharge (HID), or for any arc discharge lamps using a laminated core, an air gap whose length is from about 1% to 3%, more commonly 1% to 2%, of the magnetic circuit is provided. If iron powder is to be used for the magnetic core in such an application, the particles must be insulated from one another with no more than 1% to 3% spacing between particles. When raw iron powder is compressed even up to 100 tons per square inch and not sintered, the density remains 1% or 2% below the true density of solid iron, probably because of residual tiny crevices or interstices which remain empty. This means that the iron powder must be compressed to about 90% of theoretical density or better in order to have a distributed insulation-containing air gap not exceeding 3% in each of the three orthogonal directions one of which is that of the flux path.

Various attempts have been made in the past to form high density magnetic cores with the desired properties by compacting steel powder coated with insulating material. U.S. Pat. No. 3,245,841 describes a process for producing high resistivity steel powder by treating the powder with phosphoric acid and chromic acid to provide a surface coating on the steel particles consisting principally of iron phosphate and chromium compounds. U.S. Pat. No. 3,725,521—Ebling, describes another process for the same purpose and in which the steel particles are coated with a thermosetting resin such as a silicone resin. The same patent proposes loading the resin with an inorganic filler of smaller particle size than the steel powder, such as quartz, kaolin, talc, calcium carbonate and the like. U.S. Pat. No. 4,177,089—Bankson, proposes a blend of iron and iron-silicon aluminum alloy particles which are coated with alkali metal silicate, clay and alkaline earth metal oxide. None of these prior proposals has succeeded in producing a magnetic core of the required density and having a resistivity high enough that the core losses are not substantially greater than those occurring in the conventional laminated cores. Up to the present time there has been no commercial use of pressed iron powder cores for HID lamp ballasts.

SUMMARY OF THE INVENTION

The objects of the invention are to provide a compacted powdered iron magnetic core having high permeability and low losses comparable to those of conventional laminated ferrous sheet cores, and a practical economical process for producing such cores. More specifically a powdered iron core having a distributed air gap no greater than 3%, preferably no greater than about 2%, and having core losses comparable to those of conventional cores is sought. This would make the core practical for use in a discharge lamp ballast. It is of course desirable to achieve even lower losses and provide ballast constructions more economical of iron, and copper or aluminum conductor, than is possible with laminated cores.

An ancillary object is to provide treated iron powder which may readily be compacted and annealed in a convenient and economical process for producing such cores.

In making a pressed core embodying the invention, we use iron powder consisting of particles of suitable size which ordinarily is less than 0.05" in diameter. We apply first a continuous siliceous inorganic film. By way of preferred example, an alkali metal silicate in water solution is stirred into the iron powder which is then dried at a temperature above room temperature in order to drive out all moisture and coat the particles with a glassy inorganic coating. An overcoat of a high temperature polymer having some elasticity and ability to flow under pressure is then applied. By way of preferred example, a silicone resin overcoat may be applied by stirring the resin diluted in an organic solvent into the iron powder and air drying.

The iron powder is next compacted at not less than about 25 tons per square inch to the shape desired for the magnetic circuit component. The pressed core is then annealed to at least 500° C. to relieve the stresses in the iron particles incurred during the pressing operation. The annealing reduces the hysteresis losses but at the same time eddy current losses start to increase so it must be controlled. The silicone overcoat permits annealing at these elevated temperatures without unduly increasing the eddy current losses. Our invention produces cores having overall losses comparable to those in conventional laminated cores and thus fulfills the objects of the invention. We have also produced cores having overall losses lower than in conventional laminated cores.

DETAILED DESCRIPTION

Figure 1:
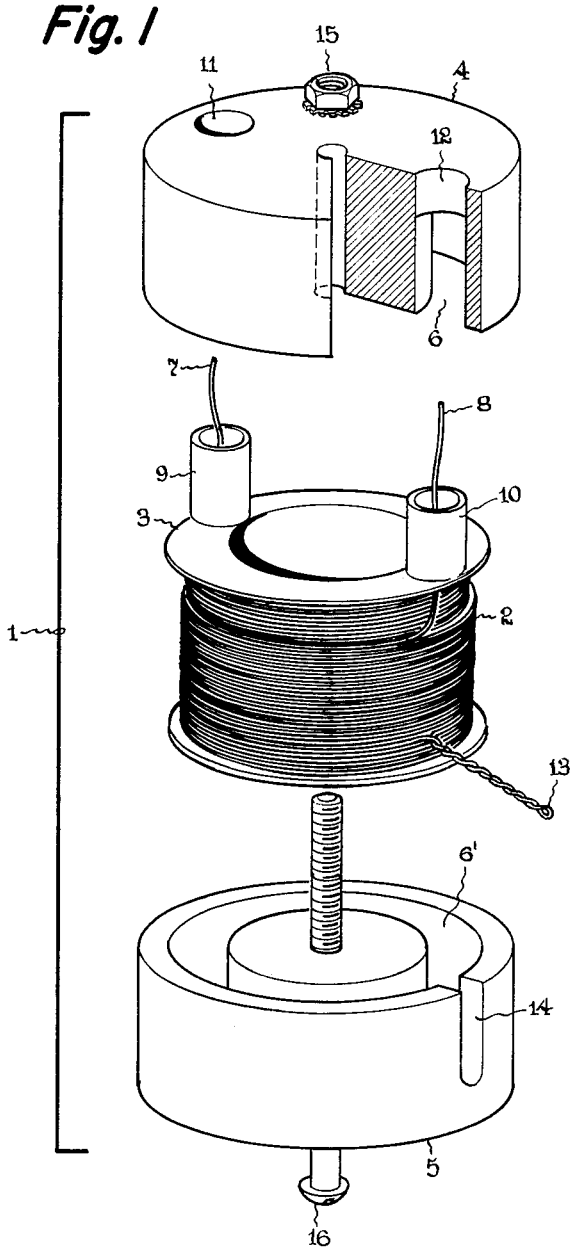
FIG. 1 illustrates pictorially in exploded fashion a pot-core reactor embodying the invention.

To make a ferromagnetic metal powder core component in accordance with our invention, we start with iron powder consisting of particles which are less than 0.05 inch in diameter. The specific particle dimension is related to the frequency at which the core is to operate, the higher the frequency the smaller the dimension desired. At the 60 hertz power line frequency commonly used in the United States, the optimum mean particle size would be slightly less than at a 50 hertz frequency as used in Japan. The particles must be small enough to assure that the losses resulting from eddy currents circulating within individual particles which have been insulated from one another are appropriately low. But with too fine particles, as the particle size approaches that of the magnetic domains, hysteresis losses will start to increase. Accordingly excessively fine particles should also be avoided, and all the more so because they cost more.

The iron powder, as the particulate iron material is generally known in the trade, may be produced by any of several known processes. In one process, a fine stream of molten iron is atomized by a high pressure jet of water. The iron particles vary in size and are not spherical but irregular in shape as is apparent upon viewing FIGS. 1*a* and 1*b*. The particle size refers to the diameter of hypothetical spherical particles that would be passed or not passed by wire screens of appropriate mesh for the size range specified.

A suitable iron powder is sold by Hoeganeas Corp. of Riverton, N.J. under the designation 1000B. It is a substantially pure iron powder having a mean particle size in the range of 0.002" to 0.006". By mean particle size we mean that upon sieving the powder, 50% by weight of particles will exceed the mean particle size and 50% will not attain it. More than 70% by weight of particles are in the range of 0.001" to 0.008". The maximum carbon content as reported by the vendor is 0.02%, typically 0.01%; maximum manganese 0.15%, typically 0.11%; traces of copper, nickel and chromium may be present. While we use pure iron powder, iron containing alloying additions such as silicon, nickel, aluminum or other elements may be used depending upon the magnetic characteristics desired.

Material Processing

The first step in treating the iron powder is to coat the particles with alkali metal silicate which will eventually provide insulation between particles in the core. Aqueous alkali metal silicate solutions are commercially available containing up to 39% by weight solids consisting of $K_2O$ and $SiO_2$, and up to 54% by weight solids consisting of $Na_2O$ and $SiO_2$. A satisfactory commercially available potassium silicate solution which we have used is sold by Philadelphia Quartz Company, Valley Forge, Pa., under the designation Kasil #1 and consists of 8.3% $K_2O$ and 20.8% $SiO_2$ in water. By way of example, we mix 50 kilograms of the previously described iron powder with 1250 ml of Kasil #1 solution and 3750 ml of water. It is desirable to add a wetting agent or surfactant to facilitate thorough and uniform coating of the particles. We have used 1.4 grams of a material sold by Rohm and Haas Co., Philadelphia, Pa. under the designation Triton X100 in which the active ingredient is an alkyl phenoxy polyethoxy ethanol.

The foregoing mixture is loaded into a mortar mixer, that is into a power-driven rotating steel drum containing internal baffles for tumbling and stirring the contents. We used a conventional plastering contractor's mixer of 2 bags' capacity. As the charge is tumbled, it is dried by blowing hot air into the mixer. Heavy duty hot air guns in which a fan or impeller blows air through electric resistance heaters were used. The mixture passes through a lumpy and tacky stage until it becomes free-flowing. The powder charge is then unloaded into flat pans to a bed depth of ½ to 1 inch, and further dried in a forced draft oven at 120° C. for 1 hour to ensure complete drying.

When the Kasil aqueous solution is dried, the resulting coating contains chemically bound water. Heating to at least about 250° C. would be required to drive out substantially all such chemically bound water and cure the potassium silicate coating on the iron particles to a glass. We avoid doing so at this stage, and heat enough to insure that all surface water is driven off but do not attempt to drive out all the chemically bound water. We have surmised that by not curing to a glass, greater flexibility is maintained in the coating which helps to preserve the insulation between particles in the pressing step yet to come.

In accordance with our present invention, we apply on the potassium silicate-coated iron particles a second very thin coating of a resin which is adherent, flexible and capable of withstanding high temperatures without decomposing into conducting residues. We have found that the combination of a glassy first coat with such a polymeric overcoat results in markedly lower losses in the pressed core after annealing. Silicone resins, which are polymers characterized by alternate atoms of silicon and oxygen with organic groups attached to the silicon atoms, are preferred for the overcoat. But other resins may be used which those skilled in the art may select from among such as the polyimides, fluorocarbons and acrylics. In poly-organo-siloxane resins, the kind of organic groups and the extent of cross-linking determine the physical characteristics of the resin. Preferred silicones are those containing alkyl and aryl groups with a balance of di- and tri-functional groups resulting in high temperature stability, good adhesion and lack of crazing. Such resins dissolved in organic solvents are available as varnishes, and are known as Class H dipping and impregnating varnishes. A suitable resin of this kind sold by General Electric Company, Silicone Products Department, Waterford, N.Y. is identified as CR-212. It is manufactured from a blend of methyl trichloro silane, phenyl trichloro silane, dimethyl dichloro silane and diphenyl dichloro silane. It is a polymethyl phenyl siloxane having an abundance of SiOH end groups giving good cross-linking and a balance of di- and trifunctional groups resulting in high temperature stability and good adhesion.

The silicone resin is aplied to the silicate-coated iron particles as a varnish in an organic solvent. The dried iron powder is removed from the drying oven and allowed to cool to room temperature. It is then put back into the mortar mixer together with 500 ml of silicone resin consisting of 20% solids in toluene. To this is added 3000 ml of toluene to further dilute the resin. As the solvent used is subsequently evaporated, its nature is not critical and any volatile readily available organic solvent which will dissolve the silicone resin may be substituted. Likewise the concentration of the treating solution is not critical and the purpose of the dilution is to facilitate mixing with the iron powder. The mixture is tumbled with a warm air flow through the mixer until dry.

The silicone overcoat in general encapsulates the individual iron particles and is insulating. But its utility in this invention is primarily that it allows annealing at a higher temperature without incurring eddy current losses than does either a silicate coating alone or a silicone coating alone. After the silicone resin coated iron powder has been tumbled dry, it is screened through a 70 mesh sieve to remove any agglomerates larger than 0.010". Such treated iron powder having a coating of alkali metal silicate and an overcoating of silicone resin is stable and fulfills the ancillary object of the invention. It may be stored in such state until needed for pressing into core components. Considering a mean particle which is 0.004" in size, the coating thickness required for a distributed air gap of 2% is about $40\times10^{-6}$ inch. For a distributed air gap of 1%, it is about $20\times10^{-6}$ inch, and for a distributed air gap of 3%, it is $60\times10^{-6}$ inch. In other words, the coating thickness should be from about ½% to about 1½% of the particle size. The silicate coating makes up 70% to 85% of the total coating, the balance being provided by the silicone resin. The silicone resin appears to become at least partially decomposed during the annealing following compacting into a core component, and its residue may make up even less of the total coating in the finished core component than the balance indicated above.

Core Manufacturing

To make a core embodying the invention, powder treated as described is compressed at better than 25 tons per square inch, preferably at 50 to 100 tons per square inch to the desired shape for the intended magnetic component. Pressing is done at room temperature and achieves approximately 93% to 95% of theoretical density.

During pressing, the iron particles are necessarily deformed in order to fill the gaps between particles and achieve the final density. The resulting strains introduce stresses into the particles which increase the hysteresis losses. In accordance with the invention, the pressed components are annealed to relieve the stresses and reduce the hysteresis losses. We have found that at least 500° C. is necessary. However excessive annealing temperature causes the eddy current losses to rise. We anneal to the temperature that results in lowest overall losses, about 600° C. for the preferred coating and overcoating described. By way of example, overall losses in a sample ballast reactor core measured at 13 kilogaus flux density and at power line frequency of 60 cycles per second were 9 watts per pound prior to annealing. Losses dropped to 5.0 watts/lb upon annealing to 600° C. A similar sample annealed to 650° C. showed losses of 6.2 watts/lb.

The surprising merit of the silicone overcoat over the silicate coating in accordance with the invention is brought out very clearly by comparing the resistivity of the materials after annealing. Sample ½" diameter slugs of compacted iron powder were prepared, some from powder coated with silicate coating alone, some from powder coated with silicone resin alone, and others from powder coated with the silicate coating and the silicone overcoat. The slugs were annealed at 600° C. Those coated with the silicate alone showed a resistance of about 500 milliohms per inch. Those coated with silicone resin alone could not be annealed without decomposition of the coating and excessive rise in eddy current losses. Those having the silicate plus silicone overcoat measured about 10,000 milliohms per inch, a remarkable twenty-fold increase over the silicate alone case.

One advantage of the use of silicone resin for the overcoat appears to be that any residue left from decomposition of the resin during annealing also contains silicon in the oxide or other insulating form. We have found that annealing should preferably be done in an oxidizing atmosphere, most conveniently in air. A reducing atmosphere such as hydrogen causes the eddy current losses to soar and must be avoided.

Pot Core Ballast

FIG. 1 shows a so-called pot core reactor ballast utilizing compressed iron powder core components made according to our invention. The ballast 1 is illustrated in vertically exploded fashion to show the coil or winding 2 on a plastic bobbin 3. The coil and bobbin are totally enclosed within the two iron powder core components 4 and 5 when the parts are pulled together. In the assembled state, the coil is located within the annular groove 6, 6'. The ends 7, 8 of the coil are brought out through insulating sleeves 9, 10 which are part of the plastic bobbin 3 and extend through holes 11, 12 in the top half core. A tap 13 in the winding is brought out through slot 14 in the bottom half core. The assembly is held together by a nut with lockwasher 15 and a long threaded machine screw 16 which extends through an axial hole in both core components.

The illustrated ballast is intended for use as a series reactance for limiting current through a high intensity discharge lamp as well as for use in discharge lamps in general. It may be used identically as the series reactance ballast and pulse starter combination shown schematically and described in U.S. Pat. No. 3,917,976—Nuckolls—Starting and Operating Circuit for Gaseous Discharge Lamps, whose disclosure is incorporated herein by reference.

The illustrated ballast was used to operate a 70 watt high pressure sodium vapor lamp on a 120 v 60 Hz A.C. line at normal power factor. Dimensions and parameters together with bench top operating measurements at 25° C. ambient temperature were as follows:

Pot Core

Core: O.D. 2½"; height 1⅞".
Bobbin: O.D. 2⅛"; I.D. 1¼"; height 1¼".
Winding: 430 turns, 407 to tap, wire copper 0.028"dia.
Overall weight: 1.02 kilogram.
Operating temp: core, 87° C.; coil, 88° C.
Power loss in ballast: 13.5 watts.

A conventional laminated E-I core ballast for operating the same lamp under the same conditions is identified by General Electric catalogue number 35-217203-R12. Dimensions and parameters together with bench top operating measurements at 25° C. ambient temperature were as follows:

E-I Core

Laminations: width 3-1/16"; height 2-11/16"; stack depth 0.825".

Bobbin: located around middle leg of E, has square aperture 0.877"×0.877".

Winding: 637 turns; 626 to tap, wire aluminum 0.0359" dia.

Overall weight: 1.14 kilogram.

Operating Temperature: core, 86° C.; coil, 100° C.

Power Loss in ballast: 17 watts.

Comparing the pot core ballast of our invention with the conventional E-I core ballast, it has achieved a 21% reduction in power loss and an 11% reduction in overall weight. Thus for the first time our invention makes possible a powdered iron core which is at least equal to and in fact better in efficiency than a conventional laminated core of the same weight.

Now that the efficiency barrier has been crossed there are many factors that favor powdered iron cores over the conventional laminated cores. The manufacturing technology requires much less labor because there are fewer parts involved and automation is relatively simple. Pot cores allowing totally enclosed ballast construction are easily made and the pot core has inherent advantages resulting from its geometry. It permits a circular cross-section and the length of wire required to wrap around a circle is approximately 13% less than required to wrap around a square enclosing the same area. The complete envelopment of the winding by the core reduces the external magnetic field to a very low value. Thus no shielding is needed to confine the magnetic field and no protection of the ballast is required. The winding substantially fills the cavity within the core components and little potting is required to completely fill the cavity. This favors good heat transfer and assures silent operation with a minimum of potting material.

While the previous example refers to 60 Hz. operation, those skilled in the art will recognize the application of other frequencies and to the use of the pressed core for reactors to be used in conjunction with electronic regulatory devices. The following two examples are considered typical:

The pot core as previously described was wound with 900 turns of 0.0201 diameter copper wire with a total air gap of 0.060 inches. A 90 volt, 70 watt high pressure sodium lamp, as used in Japan was operated from a 200 volt, 50 Hz. supply. Under steady state conditions the following data was taken:

Line volts—200 V RMS, 50 Hz.
Lamp volts—103 V RMS
Line & lamp current—0.95 ampere RMS
Line watts—88
Lamp watts—73
Total watts loss in ballast—15 watts A 400 watt high pressure mercury lamp electronic phase control ballast as produced by Eyelis Corporation in Japan, was operated using two pot cores as previously described but with 700 turns of 0.0220 diameter copper wire with a total air gap of 0.180 inches. The two reactors were operated in parallel and functioned as the main reactor in the phase control circuit. Under steady state conditions, the following test data was taken:

Line volts—200 V RMS
Lamp volts—137 V RMS
Line current—3.28 Amps RMS
Lamp current—3.27 Amps RMS
Line watts—457 watts
Lamp watts—395 watts
Total core loss—60 watts (for 2 cores)

While the invention has been described with reference to particular embodiments, and preferred reagents, procedures, conditions and components have been specified, it will be understood that numerous modifications may be made without departing from the invention. The appended claims are intended to cover all variations coming within the true spirit and scope of the invention.

What we claim as new and desire to secure by Letters Patent of the United States is:

1. A magnetic core comprising densely packed iron particles having a coating of an alkali metal silicate insulating material and an overcoating of a polymer film selected from the group consisting of silicones, polyimides, fluorocarbons and acrylics, said coating and overcoating providing substantial insulation between particles.

2. A core as defined in claim 1 wherein said core has been annealed to have a lower electrical loss characteristic.

3. A core as defined in claim 1 wherein the polymer is a silicone resin.

4. A core as defined in claim 1 which has been annealed and exhibits relatively low hysteresis losses together with relatively low eddy current losses.

5. A compacted powdered iron magnetic core component for use in A.C. electrical devices comprising:

iron powder consisting of particles sized less than 0.05 inch prior to compaction, the particles of said powder having been coated with alkali metal silicate, overcoated with a polymer film selected from the group consisting of silicones, polyimides, fluorocarbons and acrylics providing insulation between particles, and compacted to at least 90% of theoretical iron density, and the so formed compact having been annealed after said compaction and exhibiting relatively low hysteresis losses together with relatively low eddy current losses.

6. A magnetic core component as in claim 5 in which the iron has been annealed to a condition wherein the hysteresis and the eddy current losses are approximately equal at power line frequency.

7. A magnetic core component as in claim 5 wherein the mean particle size of the iron powder prior to compaction is in the range of 0.002 to 0.006 inch.

8. A magnetic core component as in claim 5 wherein at least 70% by weight of the particles are in the range of 0.001 to 0.008 inch.

9. A magnetic core component as in claim 8 which has been compacted to approximately 93% to 95% of theoretical iron density.

10. A method of making a powdered iron magnetic core component for use in A.C. electrical devices comprising:

selecting iron powder having particles sized less than 0.05 inch in diameter, mixing an aqueous solution of alkali metal silicate into said powder, drying the powder, mixing a silicone resin dissolved in an organic solvent into said powder, drying the powder to allow the resin to form a thin overcoat on the particles, and pressing the powder to the desired shape for the core component.

11. The method of claim 10 followed by the step of annealing the core component to a temperature effective for achieving substantial reduction in hysteresis losses without excessive increase in eddy current losses.

12. The method of claim 11 wherein the selected iron powder has a mean particle size within the range 0.002 to 0.006 inch.

13. The method of claim 11 wherein the mixture of iron powder and aqueous alkali metal silicate is stirred while blowing air into it until the silicate coated powder becomes free-flowing, and the coated powder is heated to drive off all surface water.

14. The method of claim 11 wherein the silicone resin is one providing a very thin overcoat of a polyorgano siloxane resin.

15. The method of claim 14 wherein the silicone resin contains alkyl and aryl groups with a balance of di- and trifunctional groups resulting in high temperature stability and substantial adhesion.

16. The method of claim 15 wherein the silicone resin is made from a blend of methyl and phenyl trichloro silanes and dimethyl and diphenyl dichloro silanes.

17. The method of claim 11 wherein the annealing has been to a temperature of at least 500° C.

18. The method of claim 11 wherein the annealing has been to a temperature of approximately 600° C.

19. The magnetic core component resulting from the exercise of the method of claim 10.

20. The magnetic core component resulting from the exercise of the method of claim 11.

* * * * *